US010920549B2

(12) United States Patent
Othman et al.

(10) Patent No.: US 10,920,549 B2
(45) Date of Patent: Feb. 16, 2021

(54) CREATING FRACTURES IN A FORMATION USING ELECTROMAGNETIC SIGNALS

(71) Applicant: Saudi Arabian Oil Company, Dhahran (SA)

(72) Inventors: Haitham A. Othman, Dhahran (SA); Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 362 days.

(21) Appl. No.: 15/970,604

(22) Filed: May 3, 2018

(65) Prior Publication Data

US 2019/0338625 A1 Nov. 7, 2019

(51) Int. Cl.
*E21B 43/24* (2006.01)

(52) U.S. Cl.
CPC ..... *E21B 43/2401* (2013.01)

(58) Field of Classification Search
CPC ..... E21B 43/267
See application file for complete search history.

(56) References Cited

U.S. PATENT DOCUMENTS 3,602,310 A 8/1971 Halbert
3,638,727 A * 2/1972 Allen ..... E21B 43/247 166/259
3,759,329 A * 9/1973 Ross ..... E21B 43/26 166/308.1
5,003,144 A 3/1991 Lindroth et al.
5,539,853 A 7/1996 Jamaluddin et al.
9,896,919 B1 * 2/2018 Chen ..... E21B 43/26
2011/0108277 A1 * 5/2011 Dudley ..... E21B 43/2401 166/308.1
2013/0265851 A1 * 10/2013 Faber ..... G01V 1/288 367/25
2015/0021013 A1 * 1/2015 Batarseh ..... H01Q 1/04 166/248

(Continued)

FOREIGN PATENT DOCUMENTS

CA 2 592 491 A1 11/2007
WO WO-2015/192202 A1 12/2015

OTHER PUBLICATIONS

Enayatpour, S. and Patzek, T., Thermal Shock in Reservoir Rock Enhances the Hydraulic Fracturing of Gas Shales, URTeC 1620617, Unconventional Resources Technology Conference, 11 pages (2013).

(Continued)

*Primary Examiner* — William D Hutton, Jr.
*Assistant Examiner* — Avi T Skaist
(74) *Attorney, Agent, or Firm* — Choate, Hall & Stewart LLP; Charles E. Lyon; Peter Flynn

(57) ABSTRACT

An example system includes a generator to generate electromagnetic (EM) signals, and a rotational device having multiple sides. The rotational device includes an antenna to direct the EM signals to a formation to increase a temperature of the formation from a first temperature to a second temperature. The antenna is on a first side of the multiple sides. A purging system is configured to apply a cooling agent to the formation to cause the temperature of the formation to decrease from the second temperature to a third temperature thereby creating fractures in the formation. The purging system is on a second side of the multiple sides.

32 Claims, 4 Drawing Sheets

(56) References Cited

U.S. PATENT DOCUMENTS

2018/0266226 A1* 9/2018 Batarseh ..... E21B 43/26

OTHER PUBLICATIONS

International Search Report for PCT/IB2018/057292, 5 pages (dated Feb. 1, 2019).
Written Opinion for PCT/IB2018/057292, 10 pages (dated Feb. 1, 2019).
Yaseen, M. et al., The Geo-materials Fracture by Thermal Process, Thirty-Ninth Workship on Geothermal Reservoir Engineering, pp. 1-6 (2014).

* cited by examiner

CREATING FRACTURES IN A FORMATION USING ELECTROMAGNETIC SIGNALS

TECHNICAL FIELD

This specification relates generally to creating fractures in a formation using electromagnetic signals.

BACKGROUND

During formation of a well a drill bores through earth, rock, and other materials to form a wellbore. The resulting wellbore may extend to, or through, a subterranean formation (or simply, "formation") that contains hydrocarbon embedded in the formation. Fractures or cracks may be produced in the formation to allow the hydrocarbon to be extracted. In some cases, the fractures or cracks may be generated by subjecting the formation to a sudden temperature change. This sudden temperature change may cause thermal shocks, which occur when a thermal gradient causes different parts of the formation to expand by different amounts. The thermal shocks in the formation produce the fractures or cracks, and allow the hydrocarbon to flow from the formation into the wellbore of the well.

SUMMARY

An example system includes a generator to generate electromagnetic (EM) signals and a rotational device having multiple sides. The rotational device includes an antenna to direct the EM signals to a formation to increase a temperature of the formation from a first temperature to a second temperature. The antenna is on a first side of the multiple sides. A purging system is configured to apply a cooling agent to the formation to cause the temperature of the formation to decrease from the second temperature to a third temperature, thereby creating fractures in the formation. The purging system is on a second side of the multiple sides. The example system may include one or more of the following features, either alone or in combination.

The first side and the second side may face in different directions. The first side and the second side may face in opposite directions.

The example system may include an enabler that is susceptible to heating by the EM signals to support the temperature of the formation increasing from the first temperature to the second temperature. The rotational device may be configured to operate within a wellbore. The EM signals may include at least one of microwaves (MWs) or radio frequency (RF) waves.

The example system may include a detector to detect sounds in the formation, and a recorder to record information representing the sounds. The example system may include one or more cleaning nozzles configured to dispense a cleaning agent to release hydrocarbons from the fractures, and to control a flow of the hydrocarbons out of the fractures. The example system may include a casing to protect at least the antenna and the enabler from physical damage.

The detector may include a transducer, or a geophone, or both a transducer and a geophone. The transducer may be used to monitor sounds from the created fractures. The geophone may be used to monitor ground movement from the created fractures. The generator may be a surface unit located on a surface of a wellbore. A guided antenna may be used to deliver the EM signals into the wellbore. The generator may be a downhole unit located inside a wellbore.

The enabler may include ceramics, activated carbon, or a combination of ceramics and activated carbon. The enabler may be located in proximity to the antenna. The enabler and the antenna may be on a first side of the multiple sides of the rotational device. The enabler may be outside the rotational device and injected into the formation. The enabler may be a powder, or a slurry, or a putty, or a combination of a powder and a slurry, or a combination of a slurry and a putty, or a combination of a powder and a putty, or a combination of a powder, a slurry and a putty. In some examples, a slurry includes a substance that is a semi-liquid mixture containing small particles suspended in water. In some examples, a putty includes a substance that is a soft, malleable paste.

The rotational device may be configured to rotate and to perform a number of heating and cooling cycles. Heating may occur from the first side of the multiple sides and cooling occurring may occur from the second side of the multiple sides.

An example method of creating fractures in a formation includes generating EM signals and directing, via an antenna, the EM signals through an enabler. The enabler may be susceptible to heating by the EM signals. The EM signals cause a temperature of a formation to increase from a first temperature to a second temperature. The antenna may be on a first side of multiple sides of a rotational device. The example method includes applying, via a purging system, a cooling agent to the formation to cause the temperature of the formation to decrease from the second temperature to a third temperature, thereby creating fractures in the formation. The purging system may be on a second side of multiple sides of the rotational device. The second side may be different than the first side. The example system may include one or more of the following features, either alone or in combination.

The example method may include monitoring sound signals in the formation and recording the sound signals. The example may include producing the EM signals using a generator. The EM signals may be produced on a surface of a wellbore. The EM signals may be produced inside a wellbore.

The enabler may be injected into the formation in a powder form to fill formation pores. The enabler may be filled into a mini-fracture created along the circumference of a wellbore. The mini-fracture may be created using a laser.

The first temperature may be a formation temperature. The formation temperature may depend on the type of reservoir. For example, the formation temperature of an oil reservoir may be 120° F. (48.8° C.) to 180° F. (82.2° C.). In another example, the formation temperature of a gas reservoir may be 270° F. (132.2° C.) to 320° F. (160° C.). The second temperature may be greater than 1,000° C. The second temperature may be less than 1,000° C. The temperature of the formation may increase from the first temperature to the second temperature in 10 to 30 minutes.

Advantages of the example systems and processes described in this specification may include one or more of the following. The systems and processes may use limited water to generate fractures and cracks in the formation of the wellbore. As such, the example systems and processes may provide a relatively clean and environmentally-friendly technology that may not damage the formation significantly. Furthermore, the example systems and processes may reduce the consumption of chemicals associated with fracturing, which may reduce the cost and environmental impact of fracturing.

Any two or more of the features described in this specification, including in this summary section, may be combined to form implementations not specifically described in this specification.

At least part of the methods, systems, and apparatus described in this specification may be controlled by executing, on one or more processing devices, instructions that are stored on one or more non-transitory machine-readable storage media. Examples of non-transitory machine-readable storage media include read-only memory, an optical disk drive, memory disk drive, random access memory, and the like. At least part of the methods, systems, and apparatus described in this specification may be controlled using a computing system comprised of one or more processing devices and memory storing instructions that are executable by the one or more processing devices to perform various control operations.

The details of one or more implementations are set forth in the accompanying drawings and the description subsequently. Other features and advantages will be apparent from the description and drawings, and from the claims.

DESCRIPTION OF THE DRAWINGS

Like reference numerals in different figures indicate like elements.

DETAILED DESCRIPTION

Figure 1:
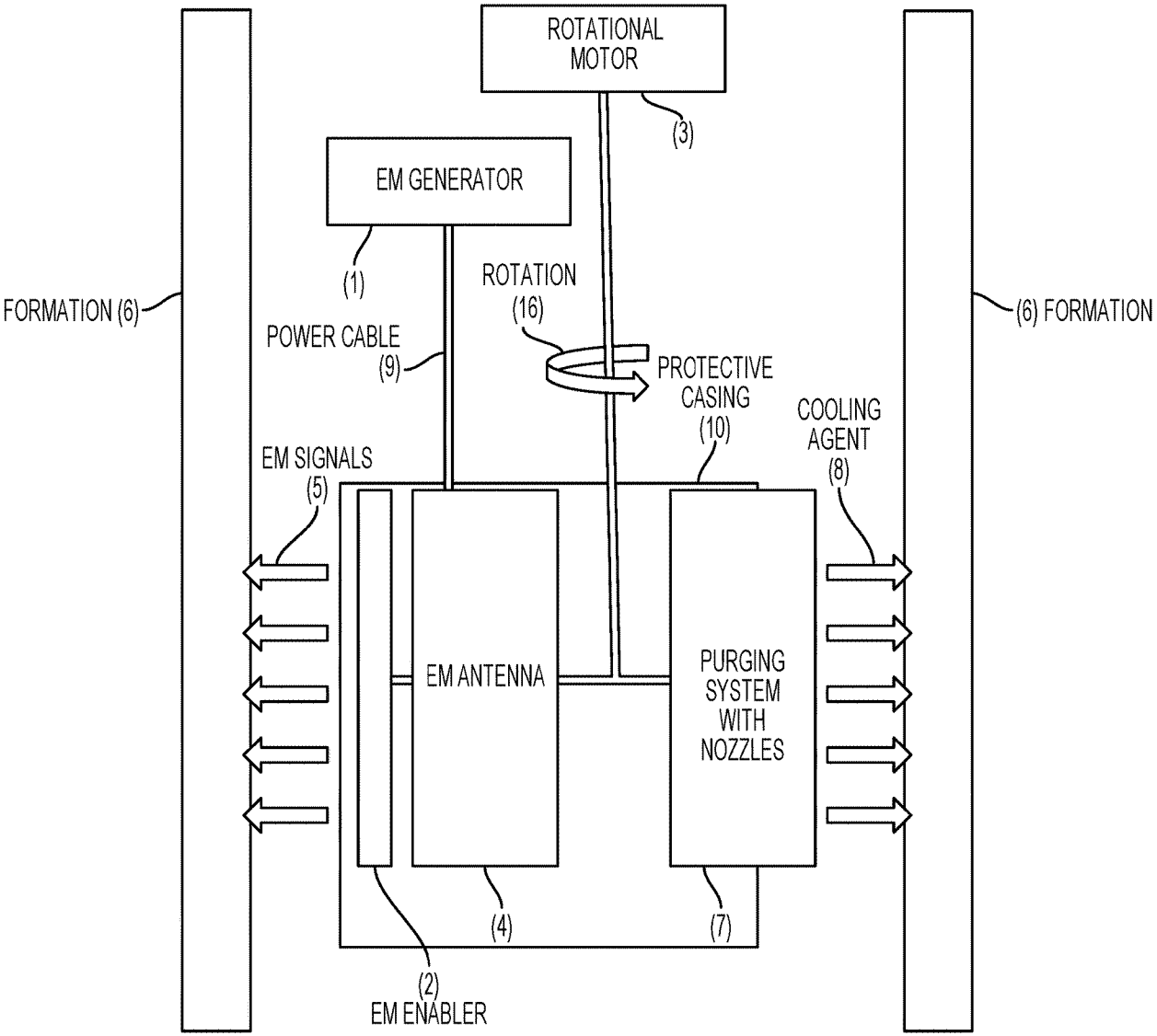
FIG. 1 is a block diagram of an example system for changing the temperature of a formation to stimulate fracturing or cracking in the formation.

Described in this specification are example systems for producing fractures or cracks in a formation (referred to as "fracturing") using electromagnetic (EM) signals. Examples of EM signals that can be used include, but are not limited to, microwaves, radio frequency (RF) signals, infrared (IR) signals, ultraviolet (UV) signals, and X-rays. The EM signals are applied to a formation to generate heat in the formation, and are applied using a tool, examples of which are described in this specification. The EM signals heat the formation to a temperature greater than an ambient temperature of the formation, called the "formation temperature". The formation temperature may depend on the type of reservoir. For example, the formation temperature of an oil reservoir may be 120° F. (48.8° C.) to 180° F. (82.2° C.). In another example, the formation temperature of a gas reservoir may be 270° F. (132.2° C.) to 320° F. (160° C.). Following heating, the parts of the formation that were heated are then cooled using a cooling agent, also applied by the tool. The heating, followed by relatively rapid cooling, causes expansion and contraction in the formation that produces the fractures or cracks, which allow hydrocarbons to be extracted from the formation. Example components of the tool are described subsequently. The tool, however, is not limited to these components, or to the combination of components.

In the examples described in this specification, the tool is used after drilling the wellbore. The tool is lowered into the wellbore proximate to the formation that is to be subjected to fracturing. For example, the tool may be lowered from a wellhead into the wellbore using any appropriate technologies. In an example, the tool is multi-sided and rotatable within the wellbore. In an example, a first side of the tool contains one or more EM generators and one or more EM antennas, which are configured to produce, and to direct, EM signals to toward the formation. The EM signals are applied at an appropriate intensity, and for an appropriate duration, to heat part of the formation to at least a predefined target temperature. For example, the predefined target temperature may be at least 1,000° C., or at least 1,100° C., or at least 1,200° C., or at least 1,300° C., or at least 1,400° C., or at least 1,500° C. A second side of the tool contains one or more purging nozzles configured to provide a cooling agent to the part of the formation that was heated by the EM signals.

In an example, the one or more EM generators and the one or more EM antennas together constitute an EM source. In operation, the EM source is arranged to face the part of the formation to be subjected to fracturing. The EM source is activated for an appropriate period of time to apply EM signals to the part of the formation to be heated. For example, an appropriate period of time may be at least 30 seconds, or at least 1 minute, or at least 2 minutes, or at least 3 minutes, or at least 4 minutes, or at least 5 minutes. The EM signals cause the temperature of the formation to rise relatively rapidly from the formation temperature—which is the ambient temperature of the formation as described previously—to a target temperature. The magnitude of the target temperature may depend on factors such as the size of the formation, and the type of rock or other materials in the formation.

The tool may then be rotated so that the purging nozzles face the part of the formation that was heated by the EM signals. The purging nozzles output cooling agent to the part of the formation that was heated to the target temperature in order to cause the temperature of the heated part of the formation to decrease relatively rapidly to a third temperature, also known as the cooling temperature. For example, the rate of change of temperature may be, but is not limited to, up to 80° C. (Celsius) per minute, or up to 90° C. per minute, or up to 100° C. per minute, or up to 110° C. per minute, or up to 120° C. per minute. The sudden change in temperature causes thermal shocks in the formation that result in fractures or cracks in the part of the formation that was heated and then cooled using the tool. These fractures or cracks facilitate extraction of hydrocarbon from the formation using appropriate technologies.

In an example operation, the tool is configured to heat the formation, and then to cool the formation, multiple times in succession. The heating and cooling may be achieved by repeatedly rotating the tool within the wellbore so that the EM source is first exposed to the part of the formation to be fractured, and then the purging system is exposed to the part of the formation that was exposed to the EM source, and so forth. For example, the tool can be used to heat the formation in the wellbore using EM signals and to cool the formation in the wellbore using the cooling agent at least 10 times, or at least 20 times, or at least 30 times, or at least 40 times, or at least 50 times, or at least 60 times, or at least at least 70 times, or at least 80 times, or at least 90 times, or at least 100 times. The multiple cycles of heating and cooling of the formation—referred to as thermal cycling—result in further propagation of fractures or cracks formed in the part of the formation. For example, the rate of propagation of fractures and cracks in the part of the formation that was heated and cooled using the tool, may depend on, but is not limited to, factors such as the size of the formation, the type of rock or other materials in the formation, the magnitude of target temperature, the number of thermal cycles, or the rate of change of temperature.

In some implementations, such as that shown in FIG. 1, the tool includes EM generator 1 to generate EM signals 5; EM enabler 2 that is susceptible to heating by the EM signals to cause a temperature of formation 6 to increase from a formation temperature to a target temperature; and rotational motor 3 having multiple sides. Rotation of rotational motor 3 having multiple sides is represented by arrow 16. For example, the rotational motor may have, two sides, or three sides, or four sides, or five sides. In some implementations, for example, the multiple sides can face in different directions. In some implementations, for example, the multiple sides can face in opposite directions.

In the example of FIG. 1 the rotational motor has two sides. In some implementations, for example, the rotational motor includes EM antenna 4 to output EM signals 5 to formation 6 to cause a temperature of the formation to increase from the formation temperature to the target temperature. In an example, the EM antenna may be on a one side of the multiple sides. In some implementations, EM generator 1 feeds power to EM antenna 4 through power cable 9. The rotational motor also includes a purging system. In this example, the purging system includes purging nozzles 7 to apply cooling agent 8 to the formation to cause the temperature of the formation to decrease from the target temperature to a cooling temperature that is closer to a temperature of the cooling agent used in order to create fractures in the formation. The purging system may be on a different side of the rotational motor than the EM antenna. In some implementations, the purging system and the EM antenna are on opposite sides of the rotational motor; however, this is not a requirement of the tool.

In some implementations, such as that shown in FIG. 1, the tool includes protective casing 10 to encase in whole, or in part, at least the EM generator, the EM antenna, and the EM enabler. The casing may be configured, arranged, or configured and arranged to protect the EM generator, the EM antenna, and the EM enabler from physical damage, or chemical damage, or physical and chemical damage, or other environmental or operational dangers.

As explained previously, the formation temperature may depend on multiple factors including the size of the formation, the type of rock or other materials in the formation, and ambient pressure in the formation. Furthermore, the magnitude of the target temperature, as discussed previously, may depend on factors such as the size of the formation, and the type of rock or other materials in the formation. For example, the target temperature may be at least 900° C., or at least 950° C., or at least 1,000° C., or at least 1,050° C., or at least 1,100° C., or at least 1,200° C., or at least 1,300° C., or at least 1,400° C., or at least 1,500° C. The cooling temperature may depend on various factors, including but not limited to, the type of cooling agent used, and the amount of cooling agent sprayed on the formation. For example, the cooling temperature may be the formation temperature. In another example, the cooling temperature may be at least 50° C., or at least 100° C., or at least 150° C., at least 200° C., or at least 250° C., or at least 300° C., or at least 350° C., or at least 400° C., or at least 450° C., or at least 500° C., or at least 550° C., or at least 600° C. The target and cooling temperatures may also be dictated by the size and extent of fractures or cracks to be formed. For example, if the fractures or cracks are to be large and extensive, the temperature differential between the target and cooling temperatures may be larger than in cases where the fractures or cracks are to be less large, less extensive, or both.

Figure 2:
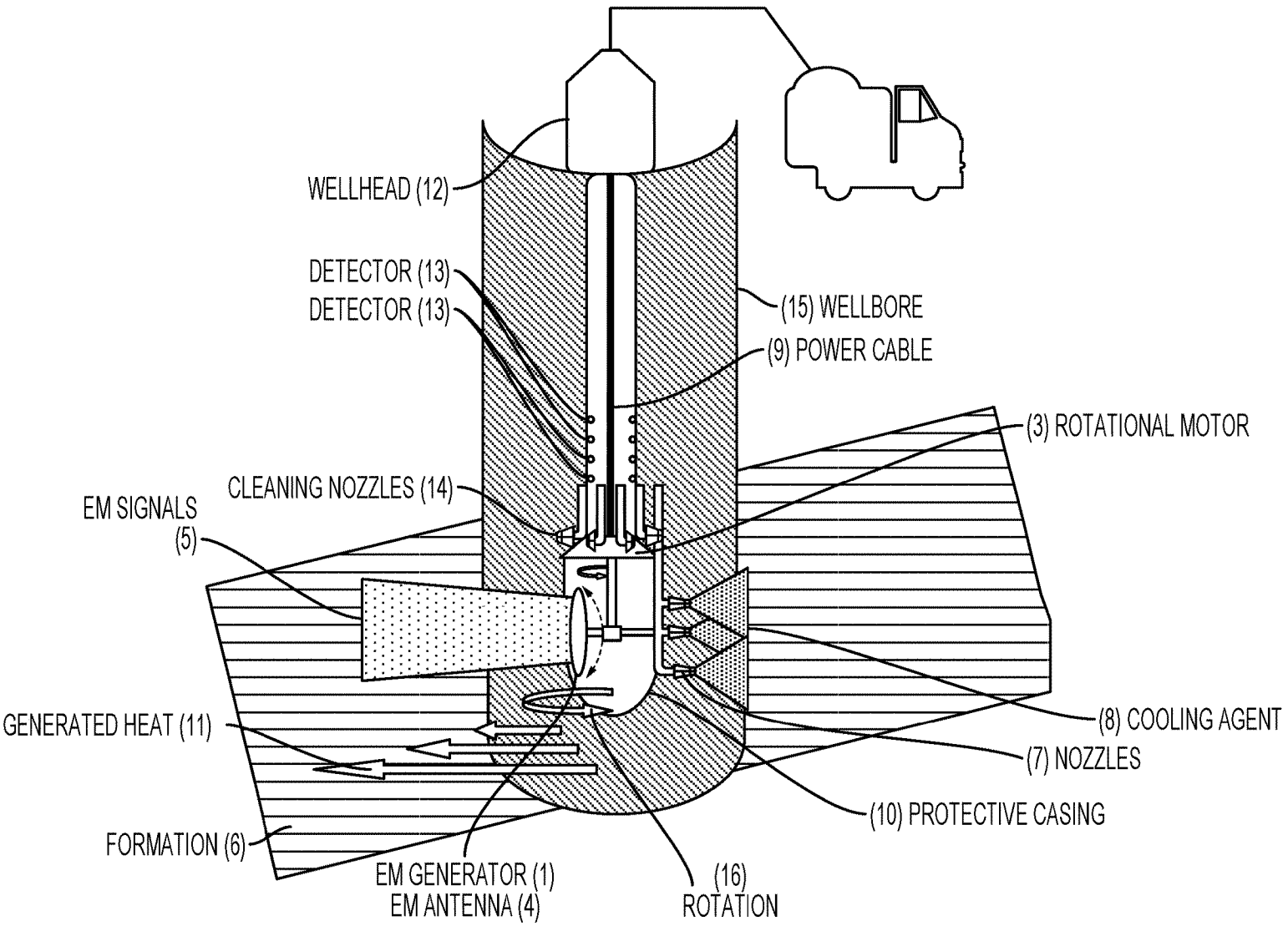
FIG. 2 is a cross-section of an example wellbore containing an example of the system having a downhole-generator unit.

Referring to FIG. 2, in an example implementation, EM generator 1 and EM antenna 4 are located on the rotational tool and are used to generate EM signals 5 downhole in the wellbore. EM generator 1 and EM antenna 4 may be fed power by power cable 9 from the surface of wellbore 15 near wellhead 12 to provide electrical energy needed to generate EM signals to heat the formation in the wellbore. In this example, the EM signals are directed by EM generator 1 and EM antenna 4 to formation 6 in the wellbore that the EM generator and EM antenna faces.

Figure 3:
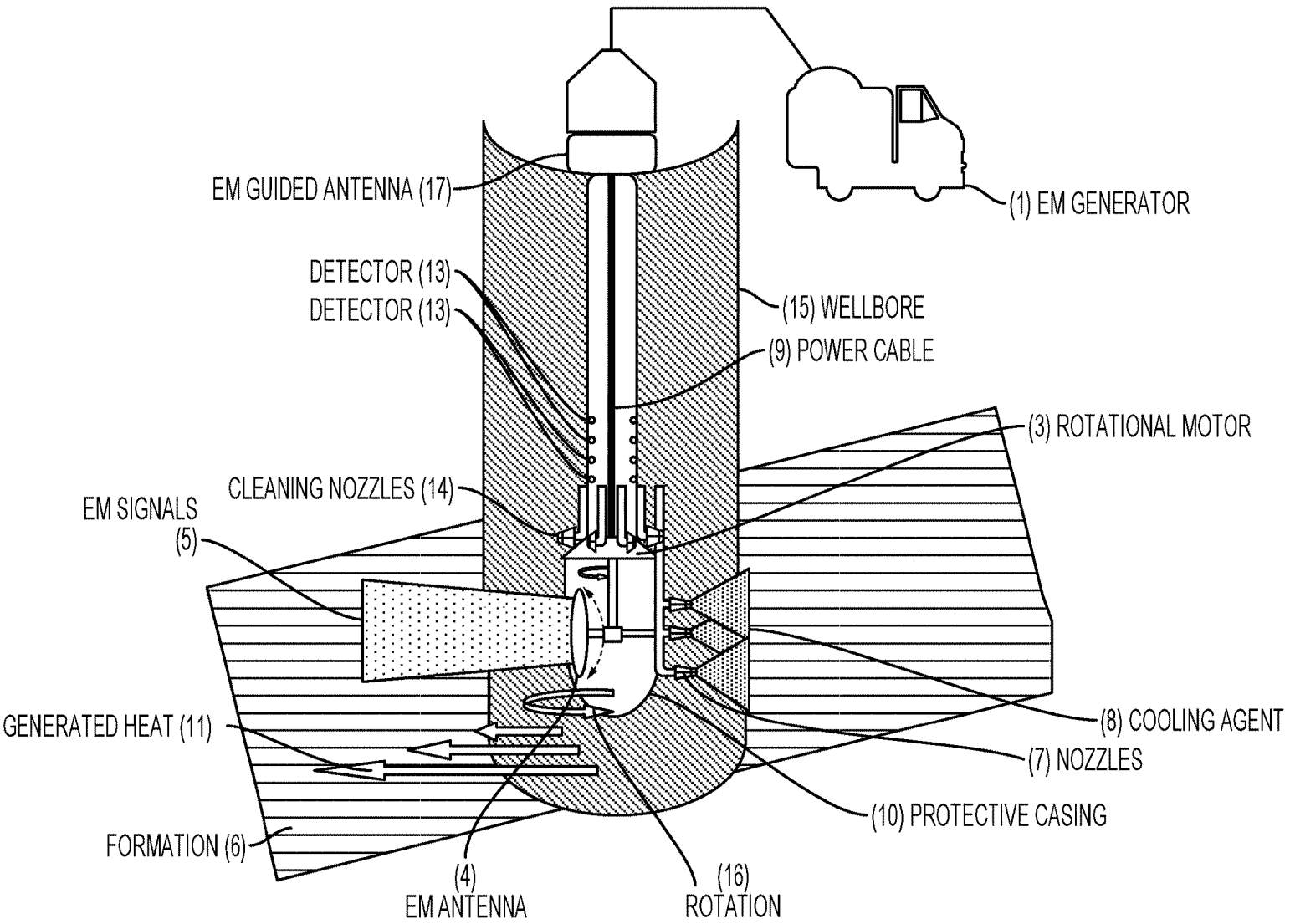
FIG. 3 is a cross-section of an example wellbore containing an example of the system having a surface-generator unit.

In some implementations, as shown in FIG. 3, EM generator 1 is located on the surface of wellbore 15, near to the wellhead. The EM signals are delivered through the wellbore using various technologies. For example, the EM signals can be delivered to the rotational motor using EM guided antenna 17. Then, EM antenna 4 located on one side of rotational motor 3 directs the EM signals through the EM enabler (not shown in FIGS. 2 and 3) to formation 6 to increase the temperature of the formation from the formation temperature to the target temperature.

In some implementations, for example, an EM enabler is located alongside EM antenna 4 on rotational motor 3 of the rotational tool. In an example, the EM enabler is located in close proximity to the EM antenna, and is configured as an EM enabler plate to be placed against the EM antenna. EM signals generated by the EM generator are then, for example, directed by the EM antenna through the EM enabler plate, thereby heating the EM enabler and generating high-energy EM signals. These high-energy EM signals contact formation 6 and increase the temperature of the formation from the formation temperature to the target temperature.

In some implementations, for example, the EM enabler is not located alongside EM antenna 4 on rotational motor 3 of the rotational tool, but is located on formation 6 or in the formation. Examples of types of EM enabler that may be used with the tool include, but are not limited to, a powder, a slurry, or a putty. In some examples, a slurry includes a substance that is a semi-liquid mixture containing small particles suspended in water. In some examples, a putty includes a substance that is a soft, malleable paste. For example, the EM enabler in powdered form may be dispersed in the formation, on the formation, or both in the formation and on the formation to fill pores of the formation around the wellbore. The EM signals generated by the generator are then, for example, directed by the EM antenna on or into the formation, causing the EM enabler powder in the pores of the formation to heat-up from the ambient or formation temperature to the target temperature. Generated heat 11 (shown as arrows in FIGS. 2 and 3) from the EM enabler at the target temperature contacts the formation and increases the temperature of the formation from the ambient or formation temperature to the target temperature.

As noted, in some implementations, the EM enabler is in the form of a slurry, or a putty. In an example, a mini-fracture may be created along a circumference of the wellbore using various technologies. For example the width of a mini-fracture is generally in millimeters. For example, a mini-fracture may have, but is not limited to, a width of 0.1 millimeter (mm), 0.2 mm, or 0.3 mm. However, regular fractures or cracks are larger. For example, regular fractures may have, but is not limited to, a width of greater than 0.5 mm. For example, a regular fracture or crack may have a width of 0.5 mm, 0.6 mm, or 1 mm. The surface length of an example mini-fracture created along the circumference of the wellbore wall using various technologies may be around a few centimeters. Examples of mini-fracture-creating technologies that are usable with the tool may include, but are not limited to, a laser, or a drill. The EM enabler is filled into the mini-fracture. The EM signals generated by EM generator are then, for example, directed by EM antenna 4 to the formation, causing the EM enabler in the mini-fracture to heat-up from the initial formation temperature to the target temperature or to a temperature that is within an acceptable tolerance of the target temperature.

The EM enabler can be made from any appropriate materials. In some implementations, for example, the EM enabler is a ceramic, an activated carbon, or a combination of a ceramic and an activated carbon. In some examples, these materials can heat-up to relatively high target temperatures, for example around 1000° C., when exposed to EM signals. The target temperature, as discussed previously, may depend on, but is not limited to, the EM enabler used, the form of the EM enabler, the size of the formation, and the type of rock or other materials in the formation. Examples of target temperature include, but are not limited to, 900° C., 950° C., 1000° C., 1050° C., and 1100° C. The rate of change of temperature may depend on multiple factors. For example, the choice of EM enabler material may affect the rate of change of temperature. The rate of change of temperature may also depend on other factors, such as the intensity of the EM signal applied, and the materials in the formation.

In some implementations, an example purging system includes one or more nozzles on a side of rotational motor 3 that is different from—for example, opposite to—the side of the rotational motor containing the EM antenna 4. For example, the purging system may include two, three, four, or any appropriate number of nozzles. The nozzles of the purging system can be arranged in different configurations. For example, the nozzles may be arranged vertically, horizontally, in a grid, or in any other pattern. In an example, referring to FIGS. 2 and 3, the nozzles 7 of the purging system are arranged vertically, one on top of the other, parallel to the longitudinal dimension of the tool. In another example, the nozzles can be arranged horizontally such that they are perpendicular to the longitudinal dimension of the tool. In another example, the nozzles can be arranged in a grid having a number of rows and columns.

The purging system is configured to spray, direct, or otherwise output a cooling agent onto the formation that has been heated from the formation temperature to the target temperature. Application of the cooling agent decreases the temperature of the heated formation from the target temperature to the cooling temperature, which is a temperature that is closer to the temperature of the cooling agent. For example, referring to FIGS. 2 and 3, the one or more nozzles 7 on the other side of the of the rotational motor sprays cooling agent 8 to cool the formation from the target temperature to the cooling temperature closer to temperature of the cooling agent. The cooling agent may be in the form of, but is not limited to, a gas, a liquid, and a fluid. The cooling temperature, as mentioned previously, may depend on multiple factors, including but not limited to the type of cooling agent used, and the amount of cooling agent sprayed on the formation. The type of cooling agent used during the fracturing process may also depend on various parameters, including, but not limited to, the target temperature to be achieved, the rate of temperature decrease desired, and the type of rock or other materials in the formation. Examples of cooling agents may include, but are not limited to, one or more of the following: air, nitrogen gas, inert gases, or water. The amount of cooling agent used to attain the cooling temperature may depend on a number of factors. These may include, for example, the type of cooling agent used, the cooling temperature desired, the type of rock or other materials in the formation, or the amount of fracturing to be achieved.

In some implementations, the rotational tool includes detector 13 for monitoring a stimulation of the formation to be fractured. For example, the detector may be configured, arranged, or configured and arranged to monitor sounds from generated fractures and cracks in the formation. Examples of the detector may include, but are not limited to, a detector having acoustic detection capabilities, geophones, or transducers. In an example, a transducer detects acoustic signals and converts them to electronic signals. In an example, a geophone detects ground movement and converts it into electronic signals.

In some implementations, referring to FIGS. 2 and 3 for example, the detector 13 includes at least a transducer that detects acoustic signals and converts the acoustic signals to electronic signals. In some implementations, the tool includes multiple transducers. For example, the tool may include two, three, four, or more transducers. In some implementations, for example, the detector includes at least a geophone that detects ground movement and converts signals representing the ground movement into electronic signals. In some implementations, the tool includes multiple geophones. For example, the tool may include two, three, four, or more geophones. In some implementations, for example, the detector includes at least a transducer and at least a geophone that monitor both acoustic signals and ground movement and convert signals representing sound and ground movement, respectively, into electronic signals. In some implementations, the tool includes multiple transducers and multiple geophones. For example, the tool may include two, three, four, or more transducers and two, three, four, or more geophones.

In some implementations, a system including the detector also includes a recorder for recording sounds from generated fractures and cracks in the formation that are detected by the detector. The recorder may be configured, arranged, or configured and arranged to record electronic signals that are outputted by the detector. The electronic signals may include or be, for example, voltage, current, radio frequency (RF) signals, or acoustic signals.

The detector and recorder combined may be used, for example, to determine the success and functionality of the fracturing operation. Indicators of operational success and functionality may include, for example, but are not limited to, increases in fracture dimensions, and increases in well productivity. Measurement of these indicators may be performed using various technologies. In some implementations the recorder may be located in close proximity to the detector. For example, the recorder may be located on the tool. In some implementations, the recorder may be located on the surface of the wellbore near the wellhead. Then, the recorder may be connected to the detector on the tool through wired or wireless technologies. In an example, the recorder may be connected to the downhole detector via a data cable. The recorder, for example, may also be connected to a downhole detector located on the tool, through various wireless technologies. For example, the recorder may be connected to the detector located on the tool through Bluetooth, WIFI, or other appropriate technologies.

In some implementations, the system includes one or more cleaning nozzles to aid in cleaning the fractures generated in the formation. For example, the tool may include two, three, four, or more cleaning nozzles 14. The cleaning nozzles can be arranged in different configurations. For example, the cleaning nozzles may be arranged vertically, horizontally, in a grid pattern, or in any other pattern. In an example, the cleaning nozzles of the tool are arranged vertically, or one on top of the other, parallel to the longitudinal dimension of the tool. In another example, referring to FIGS. 2 and 3, cleaning nozzles 14 can be arranged horizontally such that the nozzles are perpendicular to the longitudinal dimension of the tool. In another example, the nozzles can be arranged in a grid having a finite number of rows and columns.

The one or more cleaning nozzles may be configured to spray, direct, or otherwise output a cleaning agent onto the fractures in the formation that have been generated from repeated heating and cooling of the formation in the wellbore. Spraying of the cleaning agent onto the fractures in the formation may aid in cleaning the fractures and removing debris from the wellbore. Debris in the wellbore may include, for example, fractured rock fragments, mud, and plant roots. Removal of debris from the formation may facilitate, for example, further fracturing of the formation in the wellbore, and extraction of hydrocarbons. Spraying of the cleaning agent on to the fractures in the formation may facilitate removal of hydrocarbons produced from the fractures in the formation of the wellbore, and control of the flow of hydrocarbons out of the fractures. For example, non-removal of debris from the generated fractures may result in the debris such as rock fragments, remaining fracturing fluids, and mud, to plug the generated fractures, thereby preventing the flow of hydrocarbons.

In an example, referring to FIGS. 2 and 3, the one or more cleaning nozzles 14 are located on top of the rotational motor. The cleaning nozzles may be located in other locations of the tool. For example, the cleaning nozzles may be located downhole, to the side, or elsewhere relative to the rotational motor. The cleaning agent may include, but is not limited to, a gas, a liquid, or a fluid. The type of cleaning agent used during the fracturing process may depend on various parameters, including but not limited to, the depth of wellbore and the amount of fracturing of the formation the type of rock or other materials in the formation. The cleaning agent may include, but is not limited to, one or more of the following: air, nitrogen gas, inert gases, or water. The amount of cleaning agent used depends on a number of factors. These factors may include the type of cleaning agent used, the type of rock or other materials in the formation, and the amount of fracturing.

In some implementations, the tool includes a casing to protect the tool from environmental or operational dangers. Referring to FIGS. 2 and 3, for example, casing 10 is used to encase, in whole or in part, at least the EM generator, the EM antenna, and the EM enabler. The casing may be configured, arranged, or configured and arranged to protect the EM generator, the EM antenna, and the EM enabler from physical or electromagnetic damage. In some implementations, the casing can be used to encase and, therefore, to protect additional components of the tool. These additional components may include, but are not limited to, the one or more detectors located on the tool, the one or more recorders located on the tool, and additional wireless or wired technologies located on the tool.

The threat of physical damage to components of the tool may be due to elements contained in the formation or components that are part of the tool itself. Examples of elements of the formation that can cause physical damage to the tool include, but are not limited to, debris generated in the formation due to fracturing of the formation in the wellbore, or hydrocarbons in the formation generated from fractures in the formation in the wellbore. Examples of components of the tool that can cause physical damage to the tool include, but are not limited to, the cooling agent, or the cleaning agent.

In some implementations, for example, the casing is made of a material that is transparent to EM signals generated and transmitted by the encased EM generator and EM antenna. In some implementations, for example, the casing is made of a material that is transparent to both the EM signals and the heat generated and transmitted by the encased EM generator, EM antenna, and EM enabler. Examples of materials used in the casing include, but are not limited to, plastic, glass, or stainless steel. The material used to make the casing may be selected for its strength and its ability to handle extreme heat—for example up to the target temperature—and a rapid rate of change in temperature in the wellbore during the operation of the tool. In some implementations, the casing may be a pipe. For example, the pipe may have a circular cross-section, or a rectangular cross-section, or an ovoid cross-section. The dimensions of the pipe, for example, length, thickness, and diameter, may depend on various factors including, but not limited to, the type of wellbore, the depth of the wellbore, or the production capacity of the wellbore. For example, the thickness of the pipe may be at least 0.15 inches, or 0.25 inches, or at least 0.35 inches, or at least 0.5 inches, or at least 0.6 inches, or at least 0.75 inches, or at least 0.8 inches, or at least 1 inch. In some implementations, for example, a diameter of a circular cross-sectional pipe casing may include, but is not limited to, at least four inches, or at least five inches, or at least six inches, or at least seven inches, or at least eight inches, or at least nine inches, or at least ten inches.

The time needed to heat and to generate fractures in a formation of a wellbore may vary based on a number of conditions. These may include, but are not limited to, the formation temperature, the target temperature, the cooling agent used, the intensity of the EM signal, the type of rock or other materials in the formation, the electric properties of the formation, and the EM enabler. For example, it may take five minutes, ten minutes, twenty minutes, or thirty minutes, or more, for the tool to stimulate thermal shocks in the formation by rapid heating and cooling of the formation in the wellbore. The tool, however, is not limited to these durations.

The number of generated fractures in the formation of the wellbore may be different for different formations. For example, the rate of fracture generation may depend on various factors. These include, but are not limited to, the type of rock or other materials in the formation, the number of thermal cycles, the cooling agent used, and the intensity of the EM signals applied. In some implementations, generating fractures in the formation of a wellbore may include generating smaller superficial fractures on a surface of the formation in the wellbore. In some implementations, generating fractures in the formation of a wellbore may include generating large deep fractures in the interior of the formation. The depth of a fracture generated by the tool may depend on multiple factors including, but not limited to, the type of rock or other materials in the formation, the number of thermal cycles, the cooling agent used, and the intensity of the EM signals applied.

Figure 4:
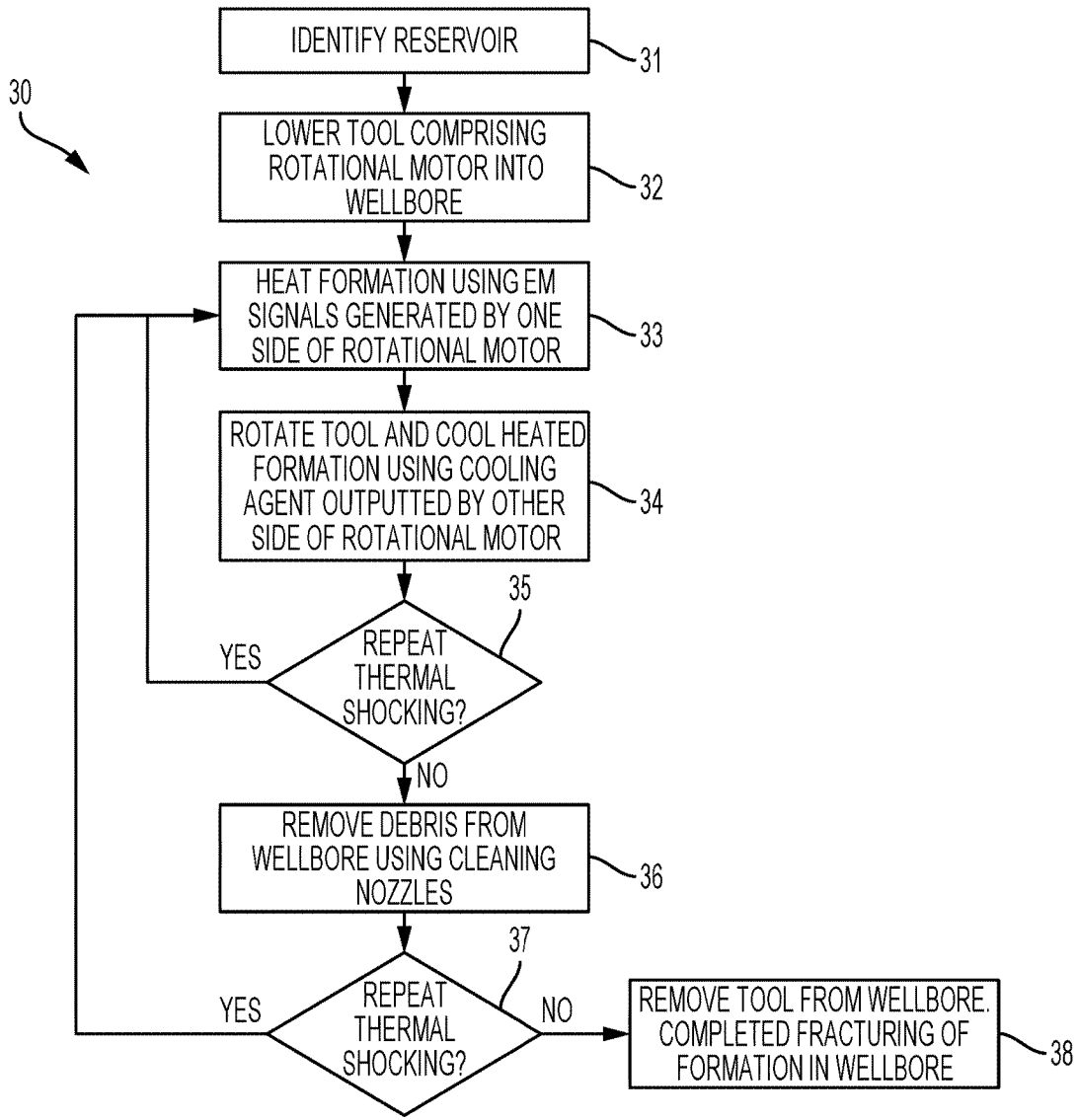
FIG. 4 is a flowchart showing an example process for changing the temperature of a formation using electromagnetic (EM) signals.

Referring to FIG. 4, a process 30 is shown for heating and stimulating fractures in a formation of a wellbore, and for producing at least part of a well using the techniques described previously. Operation 31 includes identifying a reservoir to be fractured. Operation 32 includes lowering the rotational motor of the tool into the wellbore. Examples of the tool are described throughout this specification. An example of the tool in a wellbore is shown in FIGS. 2 and 3. Operation 33 includes using one side of the rotational motor in the wellbore to direct EM signals through an EM enabler to the formation to heat the formation in a wellbore from the formation temperature to the target temperature. Techniques for directing EM energy through an EM enabler to the formation to heat the formation in a wellbore from the formation temperature to the target temperature are described previously. In this regard, FIG. 2 shows the rotational motor in a wellbore having a downhole EM generator and antenna. FIG. 3 shows the rotational motor in a wellbore with a surface EM generator 1. As shown in FIGS. 2 and 3, the EM signals generated by the surface or the downhole EM generator unit are directed through an EM enabler to the formation to increase the temperature of the formation in a wellbore from the formation temperature to the target temperature.

Operation 34 includes rotating the tool so that the purging system faces the part of the formation that was heated using the EM signals, and cooling the heated formation by outputting a cooling agent from the purging system. Techniques for applying, via the purging system, a cooling agent to the heated part of the formation are described previously. As shown in FIGS. 2 and 3, the cooling agent is applied to the heated formation to decrease the temperature of the formation in the wellbore from the target temperature to the cooling temperature, resulting in thermal shocking of the formation in the wellbore. Operation 35 includes repeating, as necessary or desired, the operations of heating and cooling the formation by rotating the tool in the wellbore to heat and to cool the part of the formation alternately. The heating and cooling cycles or the thermal cycling is repeated to produce repeated thermal shocks in the formation in the wellbore. The repeated thermal shocks to the formation in the wellbore result in fracture formation and propagation along at least part of a circumference of the wellbore.

Operation 36 includes removing debris from the wellbore using the cleaning nozzles configured to spray a cleaning agent. As discussed previously, one or more cleaning nozzles may spray a cleaning fluid that aid in removal of debris from the wellbore. This may aid, as mentioned previously, in the operation for implementing continued, uninterrupted fracturing of the formation in the wellbore. Furthermore, spraying of the cleaning agent onto the fractures in the formation may also be used to facilitate removal of hydrocarbons from the fractures in the formation, and to control the flow of hydrocarbons out of the fractures in the formation of the wellbore. Operation 37 includes determining if thermal cycling and, therefore, the thermal shocking of the formation in the wellbore are to be repeated to achieve a target fracturing of the formation in the wellbore. The success and functionality of the fracturing of the formation in the wellbore is monitored and recorded, as described previously, by the one or more detectors and recorders. After the target fracturing of the formation is achieved, operation 38 includes removing the tool from the wellbore.

Although vertical wellbores are shown in the examples presented in this specification, the example tools and processes described previously may be implemented in wellbores that are, in whole or part, non-vertical. For example, the example tools and processes may be performed for a fracture that occurs in a deviated wellbore, a horizontal wellbore, or a partially horizontal wellbore, where horizontal is measured relative to the Earth's surface in some examples.

All or part of the example tools and processes described in this specification and their various modifications (subsequently and collectively referred to as "the processes") may be controlled at least in part, by one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with controlling the processes can be performed by one or more programmable processors executing one or more computer programs to control all or some of the well formation operations described previously. All or part of the processes can be controlled by special purpose logic circuitry, such as, an FPGA (field programmable gate array), an ASIC (application-specific integrated circuit), or both an FPGA and an ASIC.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the processes described without adversely affecting their operation or the operation of the system in general.

What is claimed is:

1. A system comprising:

a generator to generate electromagnetic (EM) signals; and a rotational device comprising multiple sides, the rotational device comprising:

an antenna to direct the EM signals to a formation to increase a temperature of the formation from a first temperature to a second temperature, the antenna being on a first side of the multiple sides;

a purging system to apply a cooling agent to the formation to cause the temperature of the formation to decrease from the second temperature to a third temperature, thereby creating fractures in the formation, the purging system being on a second side of the multiple sides; and at least one cleaning nozzle disposed on the rotational device longitudinally above the purging system to remove debris from the wellbore.

2. The system of claim 1, further comprising:

an enabler that is susceptible to heating by the EM signals to support the temperature of the formation increasing from the first temperature to the second temperature.

3. The system of claim 1, where the rotational device is configured to operate within a wellbore, where the second temperature is from about 900 degrees C. to about 1,500 degrees C., and where the third temperature is from about 50 degrees C. to about 600 degrees C.

4. The system of claim 1, where the EM signals comprise at least one of infrared (IR) signals, ultraviolet (UV) signals, and X-rays.

5. The system of claim 1, further comprising:

a first plurality of detectors vertically aligned along the first side;

a second plurality of detectors vertically aligned along the second side, the first and second pluralities of detectors detecting sounds in the formation; and a recorder to record information representing the sounds, where the first and second pluralities of detectors are disposed on the rotational tool vertically above both the antenna and the purging system.

6. The system of claim 1, further comprising:

at least one rotational motor coupled to both the purging system and the antenna; and one or more cleaning nozzles configured to dispense a cleaning agent to release hydrocarbons from the fractures, and to control a flow of the hydrocarbons out of the fractures, where the one or more cleaning nozzles are located on top of the at least one rotational motor.

7. The system of claim 1, further comprising a casing to protect at least the antenna and the enabler from physical damage, where the casing comprises a pipe comprising a thickness from about 0.15 inches to about 1 inch and a diameter from about four (4) inches to about ten (10) inches.

8. The system of claim 1, where the purging system comprises from about two to about four purging nozzles, where the purging nozzles are arranged horizontally such that they are perpendicular to the longitudinal dimension of the system, and where the first side and the second side face in different directions.

9. The system of claim 1, where the first side and the second side face in opposite directions.

10. The system of claim 5, where the detector comprises at least a transducer, or at least a geophone, or at least a transducer and at least a geophone.

11. The system of claim 10, where the detector comprises a transducer, and where the transducer is configured to monitor the sounds from the created fractures.

12. The system of claim 10, where the detector comprises a geophone, and where the geophone is configured to monitor ground movement from the created fractures.

13. The system of claim 1, where the generator comprises a surface unit located on a surface of a wellbore.

14. The system of claim 13, further comprising a guided antenna to deliver the EM signals into the wellbore.

15. The system of claim 1, where the generator comprises a downhole unit located inside a wellbore.

16. The system of claim 2, where the enabler comprises a combination of ceramics and activated carbon.

17. The system of claim 2, where the enabler is located in proximity to the antenna, the enabler and the antenna being on a first side of the multiple sides of the rotational device.

18. The system of claim 2, where the enabler is outside the rotational device and injected into the formation.

19. The system of claim 18, where the enabler comprises a slurry or a putty or a combination of a powder and a slurry, or a combination of a slurry and a putty, or a combination of a powder and a putty, or a combination of a powder, a slurry, and a putty.

20. The system of claim 1, where the rotational device is configured to rotate at a speed and to perform a number of heating and cooling cycles, heating occurring from the first side of the multiple sides and cooling occurring from the second side of the multiple sides.

21. A method of creating fractures in a formation, the method comprising:

generating electromagnetic (EM) signals;

directing, via an antenna, the EM signals through an enabler, which is susceptible to heating by the EM signals, to cause a temperature of a formation to increase from a first temperature to a second temperature, the antenna being on a first side of multiple sides of a rotational device;

applying, via a purging system, a cooling agent to the formation to cause the temperature of the formation to decrease from the second temperature to a third temperature, thereby stimulating thermal shock and creating fractures in the formation, the purging system being on a second side of multiple sides of the rotational device, the second side being different than the first side;

heating and cooling the formation, via the antenna and the purging system, multiple times in succession, removing debris from the wellbore via at least one cleaning nozzle disposed on the rotational device longitudinally above the purging system, and rotating the rotational device after causing the temperature of the formation to increase and before causing the temperature of the formation to decrease.

22. The method of claim 21, further comprising:

monitoring sound signals in the formation; and recording the sound signals.

23. The method of claim 21, further comprising:

producing the EM signals using a generator.

24. The method of claim 23, where the EM signals are produced on a surface of a wellbore.

25. The method of claim 23, where the EM signals are produced inside a wellbore.

26. The method of claim 25, further comprising repeating the thermal shock of the formation after removing debris from the wellbore, where the enabler is injected into the formation in a powder form to fill formation pores.

27. The method of claim 21, where the enabler is filled into a mini-fracture created along the circumference of a wellbore.

28. The method of claim 27, where the mini-fracture is created using a laser.

29. The method of claim 21, where the first temperature is a formation temperature, and where the temperature of the formation decreases from the second temperature to the third temperature at a rate of at least 80 degrees C. per minute to 120 degrees C. per minute.

30. The method of claim 21, where the second temperature is in a range from about 1,100 degrees C. to about 1,500 degrees C.

31. The method of claim 21, further comprising generating electromagnetic (EM) signals for a period of time from about thirty (30) seconds to about five (5) minutes, where the second temperature is less than 1,000 degrees C.

32. The method of claim 21, where the temperature of the formation increases from the first temperature to the second temperature in 10 to 30 minutes.

* * * * *